US010753131B2

(12) United States Patent
Bae et al.

(10) Patent No.: US 10,753,131 B2
(45) Date of Patent: Aug. 25, 2020

(54) APPARATUS FOR PROCESSING LAUNDRY

(71) Applicant: LG ELECTRONICS INC., Seoul (KR)

(72) Inventors: Sanghun Bae, Seoul (KR); Youngjoo Lee, Seoul (KR); Hongjun Cho, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 16/336,057

(22) PCT Filed: Sep. 22, 2017

(86) PCT No.: PCT/KR2017/010450
§ 371 (c)(1),
(2) Date: Mar. 22, 2019

(87) PCT Pub. No.: WO2018/056740
PCT Pub. Date: Mar. 29, 2018

(65) Prior Publication Data

US 2019/0226254 A1 Jul. 25, 2019

(30) Foreign Application Priority Data

Sep. 23, 2016 (KR) ..... 10-2016-0122245

(51) Int. Cl.
*D06F 37/10* (2006.01)
*E05D 7/04* (2006.01)
(Continued)

(52) U.S. Cl.
CPC ..... *E05D 7/0407* (2013.01); *D06F 37/10* (2013.01); *D06F 37/28* (2013.01); *D06F 37/42* (2013.01);
(Continued)

(58) Field of Classification Search
CPC ..... D06F 37/10; D06F 37/28; D06F 37/42; D06F 39/14; D06F 58/04; D06F 58/20;
(Continued)

(56) References Cited

U.S. PATENT DOCUMENTS 3,018,508 A * 1/1962 Keeling, Sr. ..... E05D 15/52 16/232
3,698,781 A * 10/1972 Dunn ..... D06F 58/04 312/327
(Continued)

FOREIGN PATENT DOCUMENTS

KR 20-1995-0000950 2/1995
KR 20-1995-0005949 7/1995
(Continued)

OTHER PUBLICATIONS

U.S. Appl. No. 16/335,997, filed Mar. 22, 2019.
(Continued)

*Primary Examiner* — James O Hansen
(74) *Attorney, Agent, or Firm* — Ked & Associates, LLP

(57) ABSTRACT

A door for a home appliance includes four hinges which may be interchanged regarding a location on the door, and a series of interconnected arms that allow a pivot axis of the door to be changed from a first direction to a second direction by manipulation of a handle on the door.

20 Claims, 12 Drawing Sheets

(51) Int. Cl.

| | |
|---|---|
| ***E05D 15/50*** | (2006.01) |
| ***D06F 39/14*** | (2006.01) |
| ***D06F 37/42*** | (2006.01) |
| ***D06F 58/20*** | (2006.01) |
| ***D06F 58/04*** | (2006.01) |
| ***D06F 37/28*** | (2006.01) |
| ***E05D 15/52*** | (2006.01) |
| ***E05D 15/522*** | (2006.01) |

(52) U.S. Cl.
CPC ..... *D06F 39/14* (2013.01); *D06F 58/04* (2013.01); *D06F 58/20* (2013.01); *E05D 15/507* (2013.01); *E05D 15/52* (2013.01); *E05D 15/522* (2013.01); *D06F 2224/00* (2013.01); *E05Y 2900/312* (2013.01)

(58) Field of Classification Search
CPC ..... E05D 7/0407; E05D 15/52; E05D 15/507; E05D 15/522
USPC ..... 312/228, 326, 327; 68/212; 16/367
See application file for complete search history.

(56) References Cited

U.S. PATENT DOCUMENTS

| | | | | |
|---|---|---|---|---|
| 8,936,330 | B2 * | 1/2015 | Kim | E05D 11/06 312/298 |
| 2012/0161594 | A1 | 6/2012 | Kim et al. | |
| 2012/0187811 | A1 * | 7/2012 | Kim | E05D 15/52 312/228 |
| 2012/0217851 | A1 * | 8/2012 | Bae | D06F 37/28 312/222 |
| 2013/0076220 | A1 | 3/2013 | Yeom et al. | |
| 2013/0193823 | A1 * | 8/2013 | Cho | D06F 39/14 312/319.2 |
| 2014/0035453 | A1 | 2/2014 | Kwon et al. | |
| 2015/0233043 | A1 | 8/2015 | Sim et al. | |
| 2016/0076187 | A1 | 3/2016 | Lee et al. | |
| 2016/0194802 | A1 | 7/2016 | Heo et al. | |
| 2017/0009392 | A1 | 1/2017 | Lee et al. | |

FOREIGN PATENT DOCUMENTS

| | | |
|---|---|---|
| KR | 20-0138847 | 4/1999 |
| KR | 20-1999-0029441 | 7/1999 |
| KR | 10-0640751 | 10/2006 |
| KR | 10-2013-0032993 | 4/2013 |
| KR | 10-2013-0071844 | 7/2013 |
| KR | 10-2014-0018565 | 2/2014 |
| KR | 10-2015-0097185 | 8/2015 |
| KR | 10-2015-0109814 | 10/2015 |
| KR | 10-2016-0084327 | 7/2016 |
| KR | 10-1653314 | 9/2016 |

OTHER PUBLICATIONS

U.S. Appl. No. 16/336,025, filed Mar. 22, 2019.
U.S. Appl. No. 16/336,048, filed Mar. 22, 2019.
U.S. Appl. No. 16/336,057, filed Mar. 22, 2019.
International Search Report and Written Opinion (with English Translation) dated Jan. 4, 2018 issued in Application No. PCT/KR2017/010450.
International Search Report and Written Opinion (with English Translation) dated Jan. 11, 2018 issued in Application No. PCT/KR2017/010479.
International Search Report and Written Opinion (with English Translation) dated Jan. 11, 2018 issued in Application No. PCT/KR2017/010452.
International Search Report and Written Opinion (with English Translation) dated Jan. 19, 2018 issued in Application No. PCT/KR2017/010474.

* cited by examiner (a)

(b)

APPARATUS FOR PROCESSING LAUNDRY

CROSS-REFERENCE TO RELATED PATENT APPLICATIONS

This application is a U.S. National Stage Application under 35 U.S.C. § 371 of PCT Application No. PCT/KR2017/010450, filed Sep. 22, 2017, which claims priority to Korean Patent Application No. 10-2016-0122245, filed Sep. 23, 2016, whose entire disclosures are hereby incorporated by reference.

TECHNICAL FIELD

The present disclosure relates to a laundry-treating apparatus.

BACKGROUND

In general, the laundry-treating apparatus refers to a collective term of home appliances capable of washing or drying laundry, or washing and drying the laundry.

In the laundry-treating apparatus, laundry washing removes contaminants from the laundry via interaction between water and detergent. Drying of laundry removes moisture contained in laundry via a hot air supply device provided in the laundry-treating apparatus.

Conventionally, a laundry-treating apparatus includes a cabinet forming an appearance, a laundry receiving portion provided in the cabinet for receiving laundry, a laundry inlet defined in the cabinet for communicating with the laundry receiving portion, and a door for opening and closing the laundry inlet.

In the conventional laundry-treating apparatus, the door is generally pivotable about a vertical axis formed along a vertical direction of the cabinet.

DISCLOSURE

Technical Purpose

One purpose of the present disclosure is to provide a laundry-treating apparatus in which a pivoting direction of a door is switched to open a laundry inlet.

Further, another purpose of the present disclosure is to provide a laundry-treating apparatus in which a position of one of two pivoting axes mounted on a door easily switches from a left side of the door to a right side of the door or from the right side to the left side of the door.

Technical Solution

In one aspect of the present disclosure, there is provided a laundry-treating apparatus comprising: a cabinet having a laundry inlet defined therein; a laundry receiving portion defined in the cabinet, wherein the laundry receiving portion receives therein laundry through the laundry inlet; a door for opening and closing the laundry inlet; first and second fasteners disposed on the door, wherein the first and second fasteners are positioned to be axially symmetrical to each other around a vertical line passing through a center of the door; a first hinge including: a first shaft disposed on the cabinet and defining a first pivoting axis for the door; a housing fixed to the door by the first fastener or the second fastener; and a first shaft receiving portion defined in the housing, wherein the first shaft is removably received in the first shaft receiving portion; a second hinge including: a second shaft coupled to the door wherein a combination of the first and second shafts defines the first pivoting axis; and a third shaft for pivotably fixing the second shaft to the cabinet, wherein the third shaft defines a second pivoting axis for the door; a third hinge including: a fourth shaft disposed on the door, wherein a combination of the third and fourth shafts defines the second pivoting axis; a fourth shaft receiving portion disposed on the cabinet and the door, wherein the shaft receiving portion removably receives the fourth shaft therein; and a switch receiving portion disposed on the cabinet and below the shaft receiving portion; a handle including: a handle body pivotably secured to the door and an input fixed to the handle body; a first switch disposed between the first fastener and the second fastener, wherein the first switch includes first and second contacts, wherein when the handle body pivots while the housing is fixed by the first fastener, the input actuates the first contact to allow the first switch to move in a direction from the first fastener to the second fastener, wherein when the handle body pivots while the housing is fixed by the second fastener, the input actuates the second contact to allow the first switch to move in a direction from the second fastener to the first fastener, a first shaft controller configured to control the first shaft, wherein when the housing is fixed by the first fastener, the controller is fixed to a first free end of the first switch facing the first fastener, wherein when the housing is fixed by the second fastener, the controller is fixed to a second free end of the first switch facing the second fastener, wherein the controller is configured to open or close the first shaft receiving portion when the first switch moves; and a second switch, wherein when the first switch moves the first shaft controller to open the first shaft receiving portion, one of the first and second free ends of the first switch free of the first shaft controller moves the second switch toward the fourth shaft and thus the second switch is inserted into the switch receiving portion to close the fourth shaft receiving portion.

In one implementation, the apparatus further comprises: a first attached and detached portion defined in the first free end of the first switch, wherein the first shaft controller is fixedly or removably received in the first attached and detached portion; a second attached and detached portion defined in the second free end of the first switch, wherein the first shaft controller is fixedly or removably received in the second attached and detached portion; a cover disposed on the door to pivotably secure the second shaft to the door; a cover fastener disposed on the door for securing the cover to the door; and a body fastener disposed on the door to secure the fourth shaft to the door, wherein the cover and body fasteners are positioned to be axially symmetrical with each other around the vertical line passing through the center of the door.

In one implementation, the first hinge further includes: a guide disposed on the housing to guide a movement of the shaft controller; and an elastic member having one end fixed to the housing and the other end fixed to the shaft controller, wherein the elastic member presses the shaft controller to close the first shaft receiving portion.

In one implementation, the apparatus further comprises restoring means for supplying an elastic force to move the second switch to open the fourth shaft receiving portion.

In one implementation, the restoring means includes: a casing detachably secured to the door, wherein the second switch passes through the casing; and an elastic member having one end fixed to the casing and the other end fixed to the second switch, wherein the elastic member supplies an elastic force to move the second switch to open the fourth shaft receiving portion.

In one implementation, the apparatus further comprises: first and second through-holes respectively in top and bottom faces of the casing, wherein the second switch passes through the first and second through-holes; a third through-hole defined in the bottom face of the casing; a stopper extending from the second switch, wherein the stopper is positioned between the first through-hole and the third through-hole; and a guide extending from the stopper and inserted into the third through-hole, wherein the guide guides a movement of the second switch.

In one implementation, the second switch includes: a body, wherein when the housing is fixed by the first fastener, the body contacts the second free end of the first switch, wherein when the housing is fixed by the second fastener, the body contact the first free end of the first switch, wherein when the first switch moves the first shaft controller to open the first shaft receiving portion, the body moves toward the fourth shaft, and a fourth shaft controller configured to control the fourth shaft, wherein the fourth shaft controller is detachably secured to the body, wherein the body moves toward the fourth shaft, the fourth shaft controller is inserted into the switch receiving portion.

In one implementation, the third hinge includes: a third hinge body fixed to the door; a shaft support for securing the fourth shaft to the third hinge body, wherein the shaft support separates the fourth shaft and the third hinge body from each other; a shaft and switch receiving structure fixed to the cabinet, wherein the shaft and switch receiving structure includes the fourth shaft receiving portion and the switch receiving portion; a guide disposed on the third hinge body to guide the fourth shaft controller into and between the fourth shaft and the third hinge body; and an elastic member having one end secured to the third hinge body and the other end secured to the fourth shaft controller, wherein the elastic member presses the fourth shaft controller such that the fourth shaft is withdrawn out of the fourth shaft receiving portion.

In one implementation, the apparatus further comprises a first lock, wherein when the door opens the laundry inlet, the first lock is constructed to lock the first switch.

In one implementation, the second switch includes: a first body, wherein when the housing is fixed by the first fastener, the first body contacts the second free end of the first switch, wherein when the first switch moves the first shaft controller to open the first shaft receiving portion, the first body moves toward the fourth shaft; a second body, wherein when the housing is secured by the first fastener, the second body is detachably secured into and between the housing and the second hinge, wherein the first and second bodies have the same shape; and a fourth shaft controller configured to control the fourth shaft, wherein when the housing is secured by the first fastener, the fourth shaft controller is secured to the first body, wherein when the housing is fixed by the second fastener, the fourth shaft controller is secured to the second body, wherein when the first body or second body moves toward the fourth shaft, the fourth shaft controller is inserted into the switch receiving portion to close the fourth shaft receiving portion.

In one implementation, when the housing is secured by the second fastener, and when a position of the second hinge and a position of the third hinge change to define the first pivoting axis and the second pivoting axis, the first body is detachably secured into and between the housing and the second hinge; when the first switch moves the first shaft controller to open the first shaft receiving portion, the first free end of the first switch contacts the second body to move toward the fourth shaft, and the fourth shaft controller is secured to the second body.

In one implementation, the apparatus further comprises: a first protrusion protruding from the first body toward the second fastener, wherein when the housing is secured by the second fastener, the first protrusion allows the first body to be positioned between the housing and the second hinge; and a second protrusion protruding from the second body toward the first fastener, wherein when the housing is secured by the first fastener, the second protrusion allows the second body to be positioned between the housing and the second hinge.

In one implementation, the apparatus further comprises: a second lock, wherein when the door opens the laundry inlet while the door is secured by the first fastener, the second lock is constructed to lock the first body; and a third lock, wherein when the door opens the laundry inlet while the door is secured by the second fastener, the third lock is constructed to lock the second body.

In one implementation, the second lock includes: a second lock body disposed in the door; a second lock support to provide an elastic force to press the second lock body toward the first body of the first switch; a movable second lock portion passing through the door and fixed to the second lock body, wherein when the door closes the laundry inlet, the movable second lock portion moves the second lock body in a direction away from the first body of the second switch; a first stopper disposed on the first body of the second switch; and a second stopper disposed on the second lock body, wherein when the door opens the laundry inlet, the second stopper is engaged with the first stopper to prevent movement of the first body of the second switch, wherein when the door closes the laundry inlet, the second stopper separates from the first stopper, wherein the third lock includes: a third lock body disposed in the door; a third lock support to provide an elastic force to press the third lock body toward the second body of the second switch; a movable third lock portion passing through the door and fixed to the third lock body, wherein when the door closes the laundry inlet, the movable third lock portion moves the third lock body in a direction away from the second body of the second switch; a first stopper disposed on the second body of the second switch; and a second stopper disposed on the third lock body, wherein when the door opens the laundry inlet, the second stopper of the third lock is engaged with the first stopper of the third lock to prevent movement of the second body of the second switch, wherein when the door closes the laundry inlet, the second stopper of the third lock is separated from the first stopper of the third lock.

In one implementation, the apparatus further comprises: second lock pressing means, wherein when the housing is secured by the second fastener and the first body of the second switch is positioned between the housing and the second hinge, the second lock pressing means is configured for pressing the second stopper of the second lock to move away from the first body of the second switch so that the movable second rock portion is not exposed to an outside of the door; and third lock pressing means, wherein when the housing is secured by the first fastener and the second body of the second switch is positioned between the housing and the second hinge, the third lock pressing means is configured for pressing the second stopper of the third lock to move away from the second body of the second switch so that the movable third rock portion is not exposed to an outside of the door.

Technical Effect

In accordance with the present disclosure, a laundry-treating apparatus in which a pivoting direction of a door is switched to open a laundry inlet may be realized.

Further, in accordance with the present disclosure, a laundry-treating apparatus in which a position of one of two pivoting axes mounted on a door easily switches from a left side of the door to a right side of the door or from the right side to the left side of the door may be realized.

DETAILED DESCRIPTIONS

Figure 1:
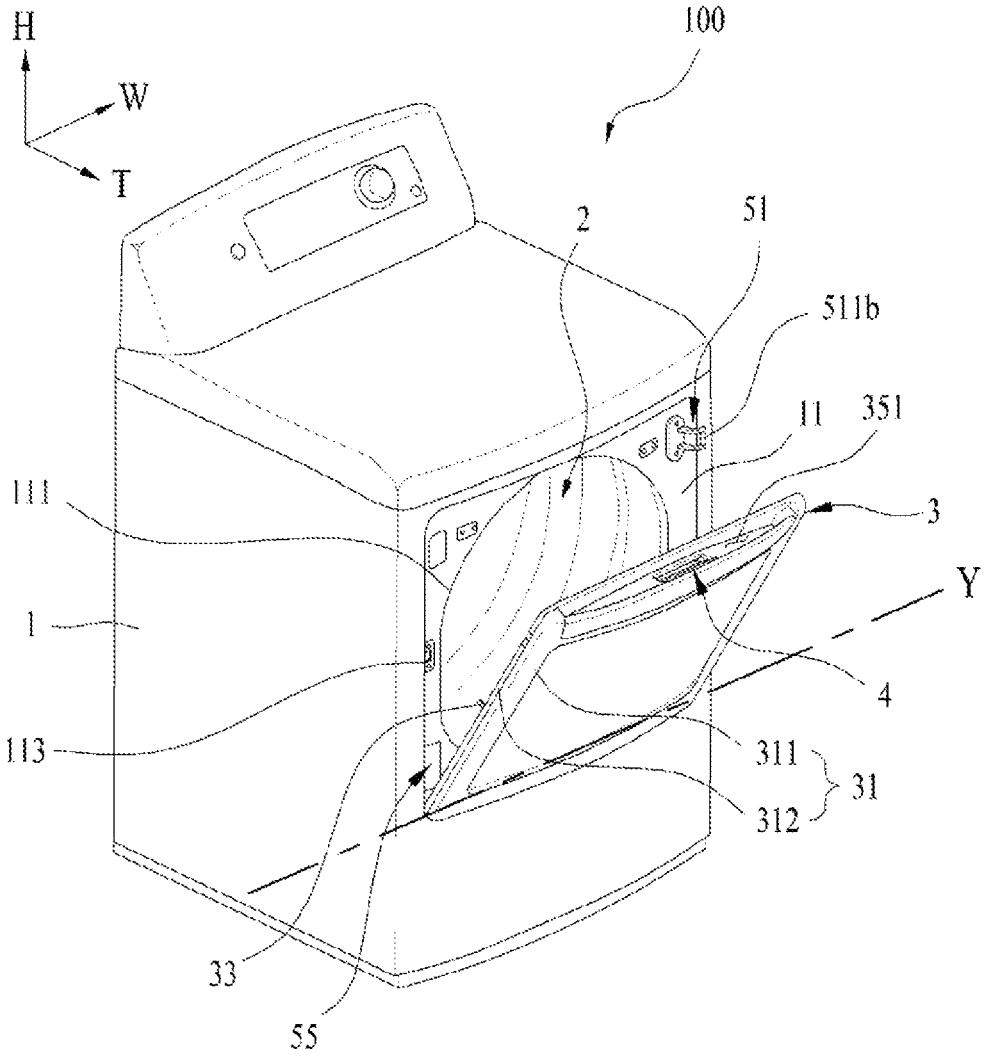
FIG. 1 shows an example of laundry-treating apparatus in accordance with the present disclosure, in which a door pivots around a second pivoting axis to open an laundry inlet.

Hereinafter, preferred embodiments of the present disclosure will be described in detail with reference to the accompanying drawings. A configuration and control method of the apparatus as described below are intended to illustrate embodiments of the present disclosure and not to limit the scope of the present disclosure. Like reference numerals refer to like elements throughout the present specification.

As shown in FIG. 1, a laundry-treating apparatus 100 according to the present disclosure includes a cabinet 1 forming an appearance, a laundry receiving portion 2 defined in the cabinet 1 for accommodating laundry, and a door 3 provided on the cabinet 1 for exposing the laundry receiving portion 2 to the outside.

A front panel 11 of the cabinet 1 has a laundry inlet 111 defined therein. The door 3 is disposed on the front panel 11 so that the laundry inlet 111 may be opened and closed by the door 3. Thus, the user may pivot the door 3 to open the laundry inlet 111 to load laundry (washing or drying target) into the laundry receiving portion 2 or draw the laundry from the receiving space 2.

When the laundry-treating apparatus 100 according to the present disclosure functions as a washing apparatus, a tub for storing wash-water therein is disposed in the cabinet, and a drum is rotatably installed in the tub and has a space for accommodating laundry defined therein. In this case, the tub has a tub laundry inlet communicating with the laundry inlet 111. The drum has a drum laundry inlet communicating with the tub laundry inlet and the laundry inlet 111.

Further, the laundry-treating apparatus 100 further includes a washing-water supply (not shown) for supplying washing water to the tub, and a washing-water discharger (not shown) for discharging washing water stored in the tub to the outside of the cabinet 1.

In an alternative, when the laundry-treating apparatus 100 according to the present disclosure only acts to dry laundry, the laundry receiving portion 2 is defined only in the drum rotatably installed in the cabinet 1. That is, the tub is absent. In this case, an air supply (not shown) is present inside the cabinet to supply hot air to the drum. Further, an air discharger (not shown) is present inside the cabinet to discharge the air from the drum to the outside of the drum.

In one example, the laundry-treating apparatus 100 according to the present disclosure may be capable of washing and drying laundry. In this case, the tub for storing wash-water therein is disposed in the cabinet, and the drum is rotatably installed in the tub and has a space for accommodating laundry defined therein. The cabinet will include a washing-water supply, a washing-water discharger, and an air supply (not shown) for supplying hot air to the tub.

The door 3 disposed on the front panel 11 for opening and closing the laundry inlet 111 is pivotable around two different pivoting axes (X, Y). The door 3 is coupled to a front panel 11 via hinges 51, 53 and 55. The user may switch the pivoting axis (X, Y) for the door 3 via the handle 4.

The door 3 may include a door body 31 for opening and closing the laundry inlet 111, and a door lock 33 for detachably fixing the door body 31 to the front panel 11.

The door body 31 may include an outer frame 311 forming an outer circumferential surface of the laundry-treating apparatus 100, and an inner frame 312 coupled to the outer frame 311 and facing the laundry inlet.

The door lock 33 may protrude from a surface of the inner frame 312. In this case, the front panel 11 may further include a door lock catch 113 into which the door lock 33 is to be accommodated. In one example, the door lock 33 and the door lock catch 113 may be embodied in any configuration as long as the door body 31 may be detachably secured to the front panel 11 via the door lock 33 and the door lock catch 113.

Figure 2:
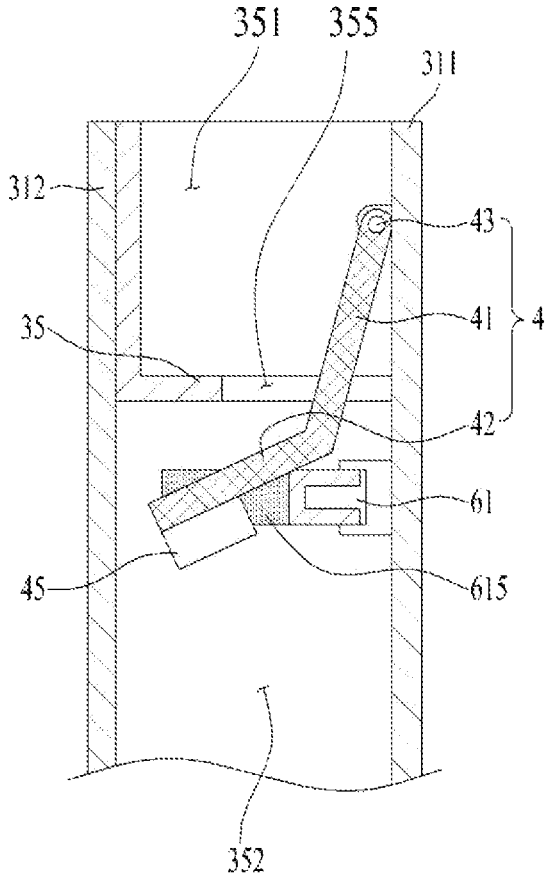
FIG. 2 shows an example of a handle disposed on the laundry-treating apparatus in accordance with the present disclosure.

As shown in FIG. 2, the door 3 includes a first receiving space 351 exposed outside the door, and a second receiving space 353 separated from the first receiving space 351 via a partitioning wall 315 and defined inside the door.

The handle 4 may include a handle body 41 and 42 pivotably secured to the door via a hinge shaft 43. The handle body is inserted into a through-hole 355 defined in the partitioning wall 35. One end of the handle body is located in the first receiving space 351, while the other end thereof is located in the second receiving space 353.

That is, the handle body may include a first handle body 41 located at the first receiving space 351 and a second handle body 42 positioned at the second receiving space 353. The first handle body 41 is pivotably secured to the outer frame 311 via the hinge shaft 43. The second handle body 42 may extend from a free end of the first handle body 41 in a bent manner toward the partitioning wall 35.

The second handle body 42 includes an input 45 that actuate a first switch (or arm or linkage or extension) 61 as described below according to a pivot angle of the first handle body 41. The first switch 61 refers to means by which the user may switch the pivoting axis (X, Y) via the second switch (or arm or linkage or extension) 63. A detailed description thereof will be described later.

Figure 3:
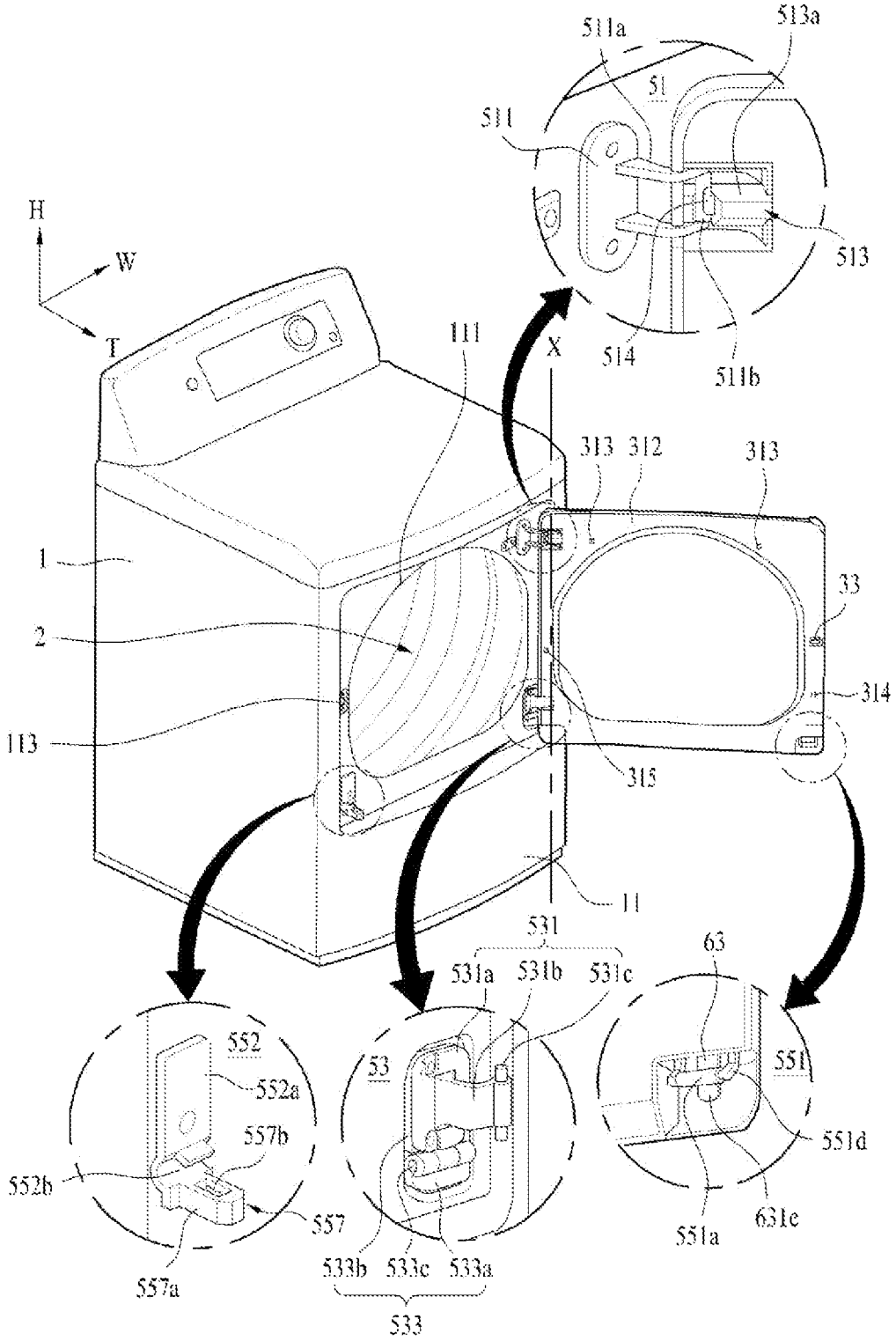
FIG. 3 shows a case when the door pivots about a first pivoting axis to open the laundry inlet.

As shown in FIG. 3, the hinge assemblies 51, 53 and 55 for coupling the door body 31 to the front panel 11 include a first hinge 51 having a first shaft 511*b*, a third hinge 551 and 552 having a fourth shaft 551*a*, and a second hinge 53 having a second shaft 531*c* defining a first pivoting axis X together with the first shaft 511*b*, and a third shaft 533*c* defining a second pivoting axis Y (see FIG. 1) together with the fourth shaft 551*a*.

The first hinge 51 may include a first hinge body 511 disposed on one of the front panel 11 and the door body 31. The first shaft 511*b* is fixed to the first hinge body 511. The first hinge 51 may further include a first shaft receiving structure 513 which is disposed on the other of the front panel 11 and the door body 3. The first shaft 511 is detachably received in first shaft receiving structure 513.

FIG. 3 shows one example in which the first hinge body 511 is fixed to the front panel 11, and the first shaft receiving structure 513 is disposed on the door body 31. In this case, the first hinge body 511 includes a shaft support 511*a* supporting the first shaft 511*b*. The shaft support 511*a* may protrude from the front panel 11 and be bent in a direction parallel to the front panel and away from the laundry inlet 111.

Figure 4:
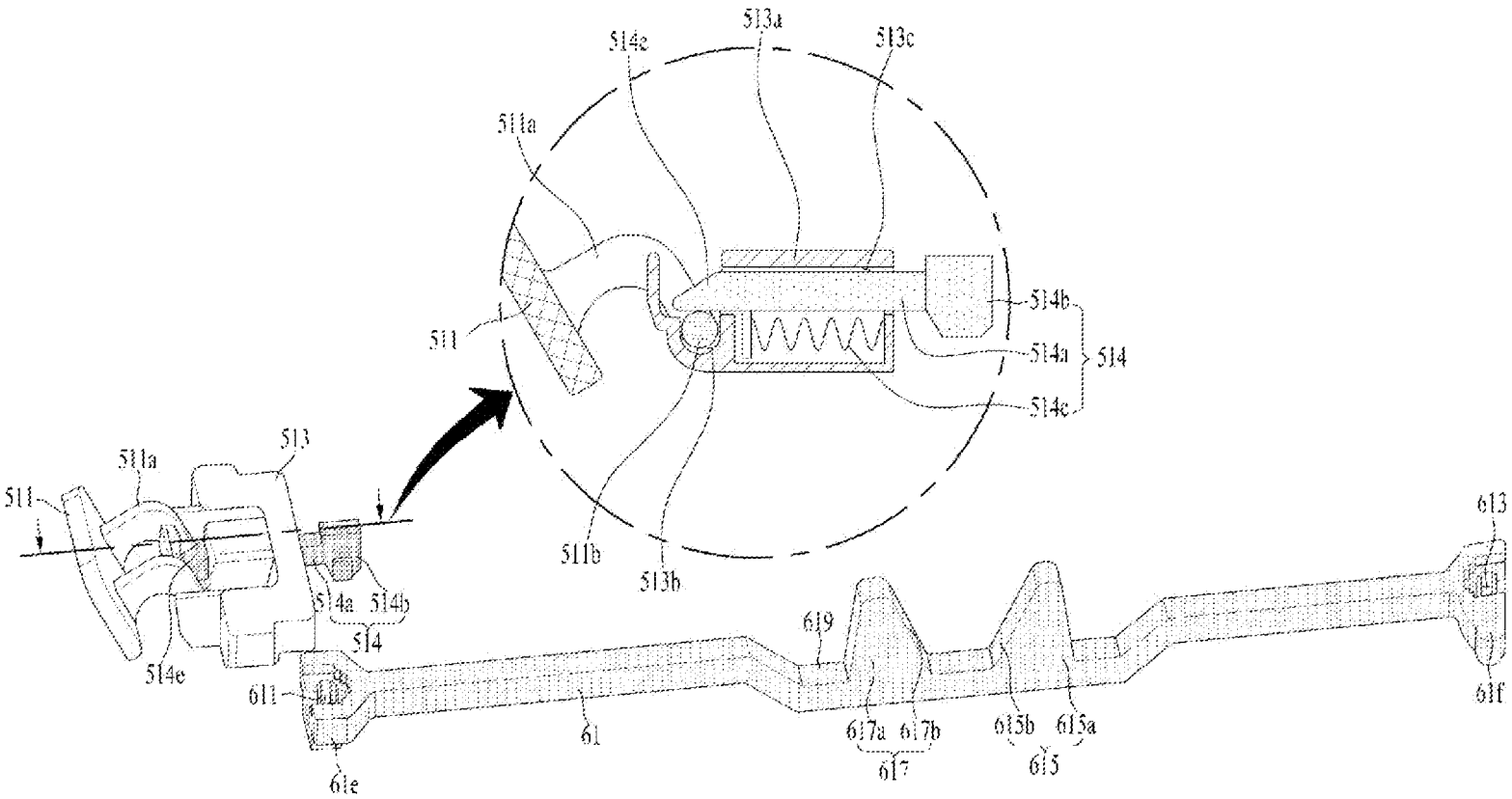
FIG. 4 shows an example of a first switch and a first shaft controller disposed on the laundry-treating apparatus in accordance with the present disclosure.

As shown in FIG. 4, the first shaft receiving structure 513 includes a housing 513*a* fixed to the door body 31, and a first shaft receiving space 513*b* defined in the housing 513*a* to provide a space for accommodating the first shaft 511*b*. In this case, the first shaft receiving space 513*b* should be disposed on the inner frame 312 so as to be exposed to the outside.

In one example, the first shaft receiving structure 513 may include a first shaft controller 514 that opens and closes the first shaft receiving space 513*b*. The first shaft controller 514 may include a first bar 514*a* inserted into a controller guide 513*c* passing through the housing 513*a*. The controller guide 513*c* acts for providing a path along which the first shaft controller 514 moves.

One end of the first bar 514*a* includes a head 514*b* that is detachably secured to the first switch 61 to be described later. Thus, the free end 514*e* of the first bar 514*a* may open or close the first shaft receiving space 513*b* depending on whether the first switch 61 actuates.

When the free end 514*e* of the first bar 514*a* closes the first shaft receiving space 513*b*, the first shaft 511*b* is prevented from being drawn out of the first shaft receiving space 513*b* or inserted into the first shaft receiving space 513*b*. However, when the free end 514*e* opens the first shaft receiving space 513*b*, the first shaft 511*b* may be withdrawn from the first shaft receiving space 513*b* or be insertable into the first shaft receiving space 513*b*.

In one example, the first bar 514*a* may be configured to receive a restoring force from an elastic member 514*c*, thereby allowing the bar 514*a* to return to an initial position. The elastic member 514*c* may include a spring. One end of the spring is fixed to the housing 513*a* and the other end thereof is fixed to the first bar 514*a*. In this case, the elastic member 514*c* is preferably configured to supply an elastic force to the first bar 514*a* so that the free end 514*e* of the first bar keeps closing the first shaft receiving space 513*b*.

The first hinge 51 may be fixed to either a left side of the door or a right side of the door via a first fastener 311*a* or a second fastener 311*b* disposed on the outer frame 311 respectively. The first fastener 311*a* and the second fastener 311*b* may be arranged to have an axial symmetry to each other around a vertical line H1 passing through a center of the door (see FIG. 5 and FIG. 8).

As shown in FIG. 3, the second hinge 53 may include a door support 531 having a second shaft 531*c*, and a cabinet hinge portion 533 for pivotably fixing the door support 531 to the front panel 11 via a third shaft 533*c*.

The cabinet hinge portion 533 may include a hinge body 533*a* secured to the front panel 11 and a pivotable plate 533*b* pivotably coupled to the hinge body 533*a* via the third shaft 533*c*.

In this case, the door support 531 may include a support body 531*a* fixed to the pivotable plate 533*b*, and a second shaft support 531*b* protruding from the support body 531*a* to support the second shaft 531*c*.

Figure 5:
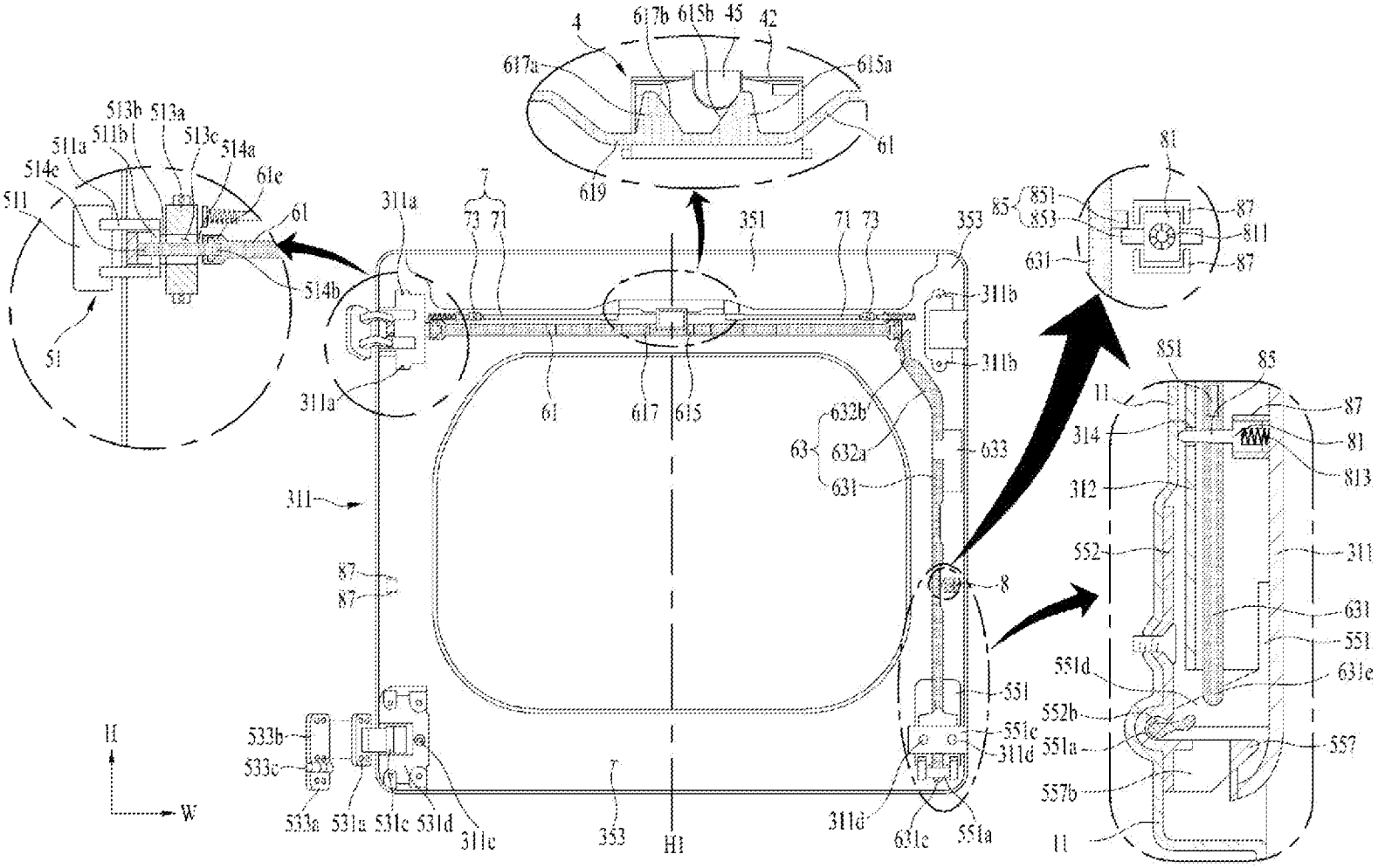
FIG. 5 to FIG. 7 show an operation of a first switch and a second switch.

The second shaft 531*c* is pivotably coupled to the door body 31 via a second shaft cover 531*d* (see FIG. 5). The second shaft 531*c* is aligned with the first shaft 511*b* of the first hinge 51 in a linear manner. Thus, the first pivoting axis X is defined by the first shaft 511*b* and second shaft 531*c*.

The third hinge may include a fourth shaft 551*a* disposed on one of the door body 31 and the front panel 11, a fourth shaft receiving structure 552 disposed on the other of the door body 31 and the front panel 11. The fourth shaft 551*a* is detachably received in the fourth shaft receiving structure 552. FIG. 3 shows an example in which the fourth shaft 551*a* is disposed on the door body 31 and the fourth shaft receiving structure 552 is disposed on the front panel 11.

The fourth shaft receiving structure 552 may include a body 552*a* secured to the front panel 11, a fourth shaft receiving space 552*b* defined in the body 552*a* and providing a space for receiving the fourth shaft 551*a*, and a switch receiving portion 557 extending from the body 552*a*. A free end 631*e* of the second switch 63 to be described later is inserted into the switch receiving portion 557.

The fourth shaft receiving space 552*b* may be embodied as a groove formed by concavely bending the body 552*a*. The fourth shaft receiving space 552*b* is aligned in parallel with (in the same straight line) the third shaft 533*c* of the second hinge 53. The fourth shaft 551*a* inserted in the fourth shaft receiving space 552*b* defines the second pivoting axis Y (see FIG. 1) together with the third shaft 533*c*.

The switch receiving portion 557 may include a receiving body 557*a* protruding from the body 552*a* and located below the fourth shaft receiving space 552*b*, and a through-hole 557*b* penetrating the receiving body 557*a*.

In one example, as shown in FIG. 5, the fourth shaft 551*a* may be disposed on a third hinge body 551 fixed to the door body 31. The third hinge body 551 includes a fourth shaft support 551*d* that spaces the fourth shaft 551*a* from the third hinge body 551 by a predetermined distance. The fourth shaft 551*a* fixed to the fourth shaft support 551*d* is exposed to the outside of the inner frame 312.

The third hinge body 551 may further include a guide 551*c* for providing a travel path of the second switch 63, which will be described later. The guide 551*c* may include at least one of a groove extending in a vertical direction of the third hinge body 551 and receiving the second switch 63, and a cover (not shown) that prevents the second switch 63 inserted in the groove from being pulled out of the groove.

The second hinge 53 may be fixed to the door 3 via a shaft cover fastener 311*c* disposed on the outer frame 311. The third hinge 55 may be fixed to the door 3 via a body fastener 311*d* disposed on the outer frame 311.

In this case, the second hinge 53 may be fixed to the door via the shaft cover fastener 311*c* (for example, bolt) passing through the second shaft cover 531*d*. The third hinge 55 will be secured to the door via the body fastener 311*d* (for example, bolt) passing through the third hinge body 551 or guide 551*c*.

In order that a position of the second hinge 53 and a position of the third hinge 55 may be exchanged with each other, the shaft cover fastener 311*c* and the body fastener

311*d* may be disposed axially symmetrically with each other around the vertical line H1 passing through the center of the door.

The interior of the door 3 includes pivoting axis switches 61 and 63, which enables the pivoting axis (X, Y) of the door to switch depending on whether an external force is applied to the handle 4.

The pivoting axis switches may include a first switch 61 for controlling a position of the first shaft controller 514 to open and close the first shaft receiving space 513*b*, and a second switch 63 actuated by the first switch to close the fourth shaft receiving space 552*b* when the first shaft receiving space 513*b* is opened.

The first switch may translate in a width direction W of the door. As shown in FIG. 4, both ends 61*e* and 61*f* of the first switch 61 include a first attached and detached portion (or first accommodation groove) 611 and a second attached and detached portion (or second accommodation groove) 613 respectively to which the first shaft controller 514 is detachably fixed. That is, a first free end 61*e* of the first switch includes the first attached and detached portion 611, while a second free end 613 of the first switch includes the second attached and detached portion 613.

Each of the first attached and detached portion 611 and second attached and detached portion 613 may be embodied in any shape as long as the head 514*b* of the first shaft controller is detachably secured into the first attached and detached portion 611 and second attached and detached portion 613.

As shown in FIG. 5, the first switch 61 include a first contact 615 and a second contact 617. When an external force is exerted on the handle and pivots the handle body 41 and 42, the first contact 615 and second contact 617 receives the force from the input 45 of the handle and thus move the first switch 61. The first contact 615 and the second contact 617 may act for transmitting the external force input to the handle 4 to the first switch 61.

When the housing 513*a* of the first hinge is fixed via the first fastener 311*a* (FIG. 5), the first switch 61 contacts the input 45 via the first contact 615. When the housing 513*a* is fixed via the first fastener 311*a* and an external force is input to the first handle body 41, the input 45 presses the first contact 615, thereby causing the first switch 61 to move from the first fastener 311*a* toward the housing second stopper 311*b*.

To this end, the first contact 615 may include a contact body 615*a* projecting from the first switch 61 toward the input 45, and an inclined face 615*b* disposed on the contact body and contacting the input 45. The inclined face 615*b* may incline upwardly as it goes away from the first free end 61*e* of first switch.

In one example, when the housing 513*a* is secured via the second fastener 311*b* (FIG. 8), the first switch 61 is configured to contact the input 45 via the second contact 617. When the housing 513*a* is fixed via the second fastener 311*b* and an external force is input to the first handle body 41, the input 45 presses the second contact 617, thereby causing the first switch 61 to move from the second fastener 311*b* toward the first fastener 311*a*.

The second contact 617 may also include a contact body 617*a* projecting from the first switch 61 toward the input 45 and an inclined face 617*b* contacting the input 45. In this case, the inclined face 617*b* of the second contact 617 should have an upward slope as it goes away from the second free end 61*f* of the first switch.

In one example, the first contact 615 and the second contact 617 have to be disposed in the door body 31 with a limited thickness. Thus, the first switch 61 may further have a bent portion 619 bent toward the outer frame 311. The first contact 615 and the second contact 617 may be disposed in the bent portion 619.

The second switch 63 may play a following role. When the first switch 61 moves the first shaft controller 514 so that the first shaft receiving space 513*b* defined in the first hinge is opened, the second switch 63 may prevent either the free end 61*e* or 61*f* from moving the first shaft controller toward the fourth shaft 551*a* and thus prevent the fourth shaft 551*a* from being drawn out of the fourth shaft receiving space 552*b*.

That is, when the housing 513*a* is fixed by the first fastener 311*a*, the second switch 63 may be configured to contact the second free end 61*f* of the first switch. When the housing 513*a* is fixed by the second fastener 311*b*, the second switch 63 may be configured to contact the first free end 61*e* of the first switch.

A first free end 631*e* of the second switch may be disposed between the fourth shaft 551*a* and the third hinge body 551. A second free end 631*f* of the second switch contacts the second free end 61*f* of the first switch. The second switch may have a bar shape.

In this case, the second switch 63 may include a bar-shaped first body 631 that reciprocates between the second fastener 311*b* and the fourth shaft 551*a*, and a first movable portion or pin 631 connecting the first body 631 and the second free end 61*f* of the first switch.

The first movable portion 632 may include a first connection body 632*a* extending from the first body 631 toward the first switch 61, and a first inclined face 632*b* disposed on the first connection body 632*a* and contacting the second free end 61*f* of the first switch.

The first inclined face 632*b* has a downward slope as it goes away from the first free end 631*e* of the second switch. Thus, when the first switch 61 moves from the first fastener 311*a* toward the second fastener 311*b*, the first body 631 moves toward the fourth shaft 551*a*.

When the first body 631 moves toward the fourth shaft 551*a*, the fourth shaft receiving space 552*b* is closed by the first body 631. That is, when the first body 631 moves toward the fourth shaft 551*a*, the first free end 631*e* of the second switch will be inserted into the through-hole 557*b*. Thus, the fourth shaft 551*a* inserted in the fourth shaft receiving space 552*b* is prevented from being drawn out from the fourth shaft receiving space.

In one example, the first inclined face 632*b* may remain in contact with the second free end 61*f* of the first switch via restoring means 633. The restoring means 633 may include a spring that urges the first body 631 toward the first switch 61 (in a direction in which the first free end of the second switch opens the fourth shaft receiving space).

Figure 6:
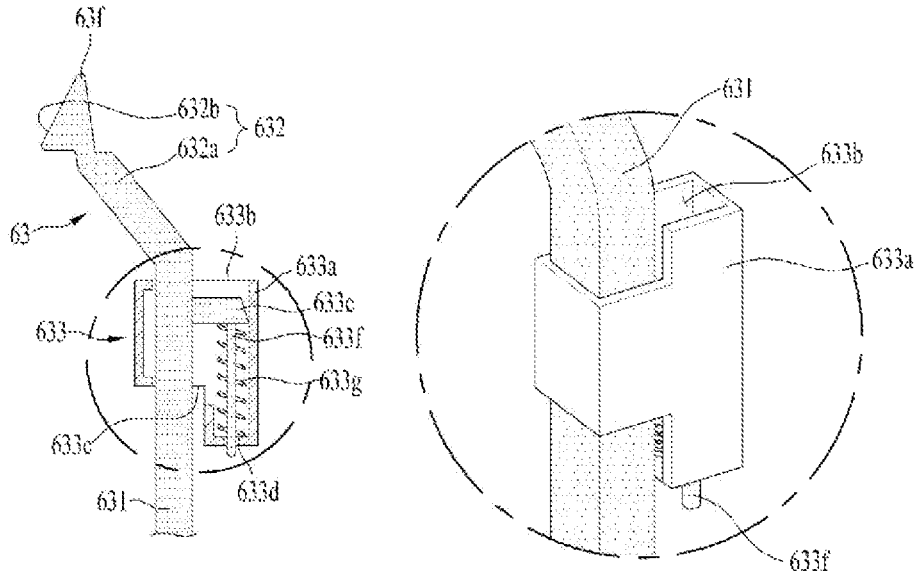

Further, the restoring means 633 may have a structure shown in FIG. 6. That is, the restoring means 633 includes a casing 633*a* detachably fixed to the door 3, a first through hole 633*b* and a second through hole 633*c* in which the first body 631 is inserted, wherein the first through hole 633*b* and second through hole 633*c* are respectively defined in top and bottom faces of the casing, and a spring 633*g* having one end fixed to the casing 633*a* and the other end fixed to the first body 631, wherein the spring may supply an elastic force to move the second switch 63 toward the first switch 61

When the restoring means 633 is configured in the above-described manner, a following advantage may occur. When the user changes the positions of the housing 513*a*, the second hinge 53 and the third hinge body 551 to change the position of the first pivoting axis X, the spring 633*g* may be moved together with the second switch 63, such that the process of repositioning of the first pivoting axis X may be facilitated.

In order to facilitate the reciprocating movement of the first body 631 along the vertical direction H of the door, the restoring means 633 may further include a third through-hole 633*d* defined in a bottom face of the casing, a stopper 633*e* extending from the first body 631 and disposed between the third through hole 633*d* and the first through hole 633*b*, and a vertical guide 633*f* vertically extending from the stopper 633*e* to be inserted into the third through-hole 633*d*. The guide 633*f* and the third through-hole 633*d* provide for means for guiding the movement of the first body 631.

Hereinafter, an operation of the first switch 61 and the second switch 63 having the above structure will be described with reference to FIG. 5 and FIG. 7.

When external force is applied to the handle 4 in the state shown in FIG. 5, the input 45 presses the inclined face 615*b* disposed on the first contact 615.

When the inclined face 615*b* of the first contact is pressed, the first switch 61 moves from the first fastener 311*a* toward the second fastener 311*b*.

Figure 7:
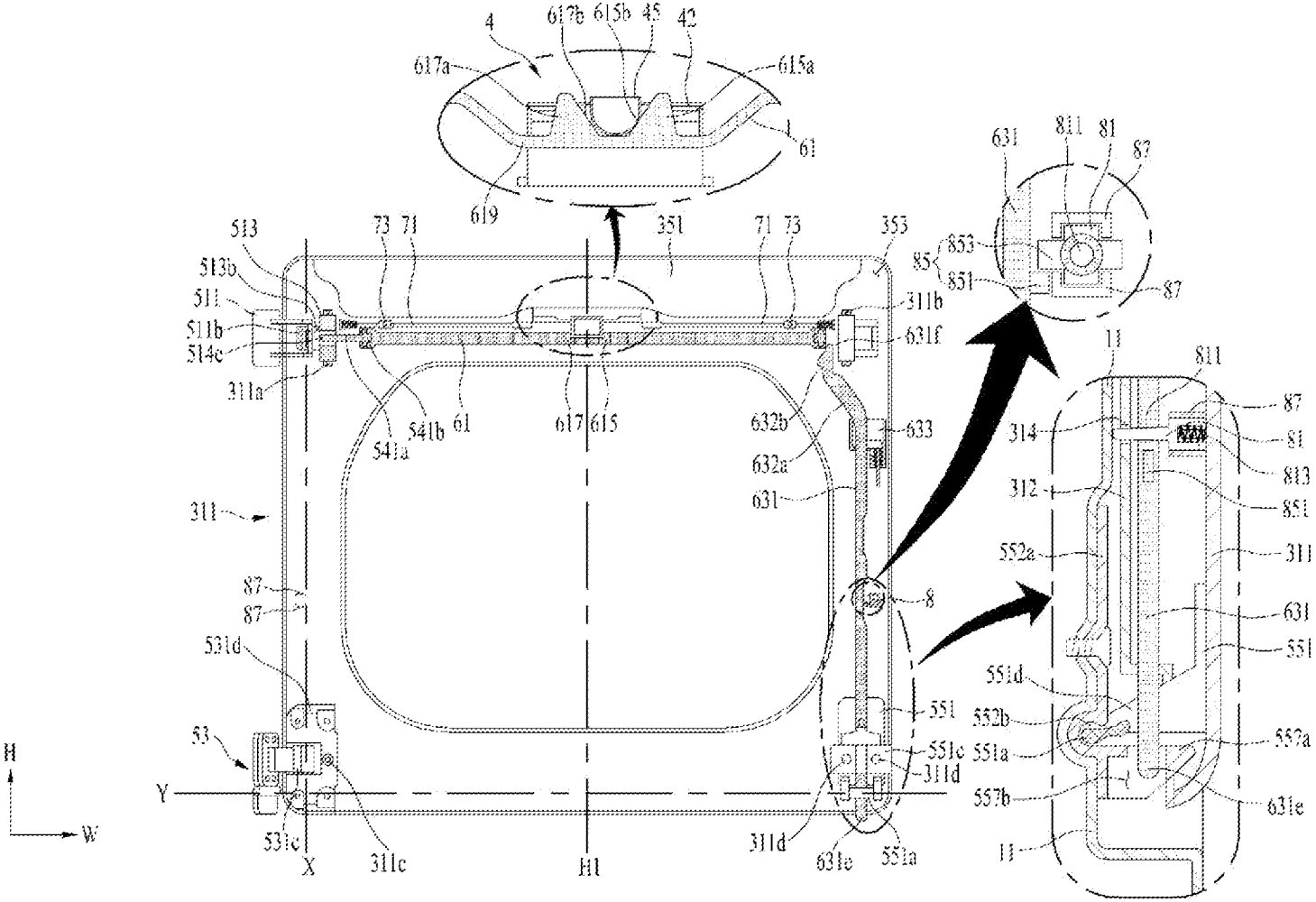

When, as shown in FIG. 7, the first switch 61 moves toward the second fastener 311*b*, the first bar 514*a* of the first shaft controller will also move toward the second fastener 311*b*. When the first bar 514*a* moves toward the second fastener 311*b*, the free end 514*e* of the first bar will open the first shaft receiving space 513*b*. Thus, the first shaft 511*b* is ready to be drawn out from the first shaft receiving space 513*b*.

In one example, when the first switch 61 moves toward the second fastener 311*b*, the second switch 63 contacting the second free end 61*f* of the first switch via the first movable portion 632 will move toward the fourth shaft 551*a*.

When the second switch 63 moves toward the fourth shaft 551*a*, the second switch first free end 631*e* is inserted into the through hole 557*b* defined in the switch receiving portion 557. When the first free end 631*e* is inserted into the through-hole 557*b*, the fourth shaft receiving space 552*b* is closed by the first body 631. Thus, the fourth shaft 551*a* will not be drawn out of the fourth shaft receiving space 552*b*. Therefore, the door 3 becomes pivotable around the second pivoting axis Y.

When the external force input to the handle 4 disappears, the first switch 61 and the second switch 63 return to the state of FIG. 5 via the first elastic member 514*c* disposed on the first shaft controller and via the restoring means 633 disposed on the second switch.

That is, when the laundry inlet 111 is closed by the door and when the external force input to the handle 4 disappears, the first bar 514*a* of the first shaft controller and the first switch 61 move toward the first fastener 311*a* via the first elastic member 514*c*.

When the first bar 514*a* moves toward the first fastener 311*a*, the first shaft receiving space 513*b* will be closed by the free end 514*e* of the first end. Thus, the first shaft 511*b* inserted in the first shaft receiving space 513*b* may be prevented from being drawn out from the first shaft receiving space 513*b*.

When the external force input to the handle 4 disappears while the inlet 111 is closed by the door 3, the restoring force provided by the restoring means 633 may allow the second switch 62 to move in a direction away from the fourth shaft 551*a*. When the second switch 63 moves away from the fourth shaft 551*a*, the free end 631*e* of the second switch may be drawn out from the through-hole 557*b*. Thus, the fourth shaft 551*a* may be drawn out from the fourth shaft receiving space 552*b*.

In this state, the user pulls the door 3 without pressing the handle 4. Thus, the door 3 will pivot around the first pivoting axis X to open the laundry inlet 111.

The laundry-treating apparatus 100 having the above-described structure has the effect of facilitating the change of the position of the first pivoting axis X from one of the left side and the right side of the door to the other of the left side and right side of the door 3.

The users of the laundry-treating apparatus may be classified into a left-handed person and a right-handed person. Thus, the manufacturer of the laundry-treating apparatus or the installer of the laundry-treating apparatus need to change the position of the first pivoting axis X according to the user's preference. The laundry-treating apparatus 100 according to the present disclosure facilitates changing the position of the first hinge 51 from the left side of the door to the right or from the right side of the door to the left side, moving the second hinge 53 toward the third hinge 55, and moving the third hinge 55 toward the second hinge 53. Thus, this may simplify the process of changing the first pivoting axis X by the producer or installer.

As shown in FIG. 7, the first shaft controller 514 is disposed on the first hinge 51. The first shaft controller 514 may be coupled to each of the first free end 61*e* and second free end 61*f* of the first switch. The first fastener 311*a* and the second fastener 311*b* are arranged in an axial-symmetric manner with respect to each other around the vertical line H1. Therefore, when intending to change the position of the first pivoting axis X, the producer or the operator may change the position of the first pivoting axis X via the following simple process.

Figure 8:
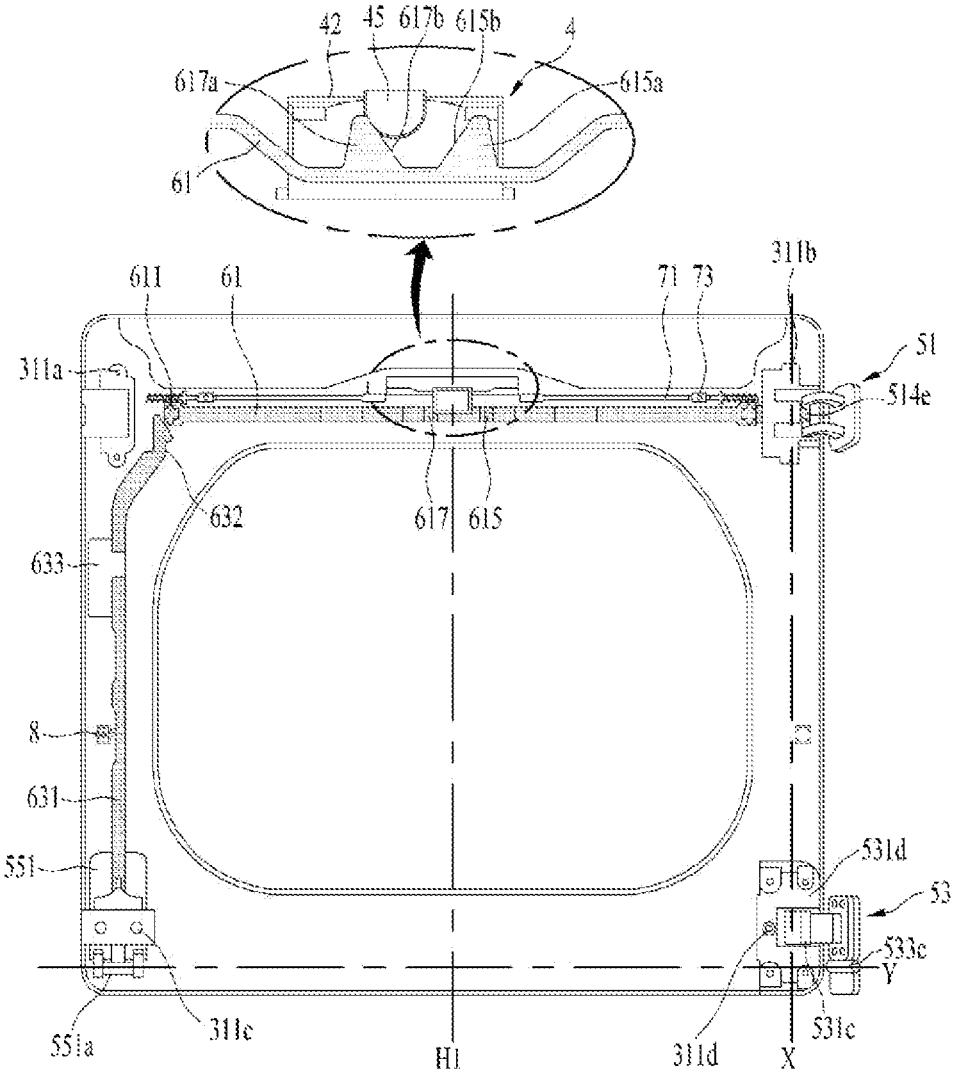
FIG. 8 shows a state in which a position of a first pivoting axis switches from a left of the door to a right side of the door.

That is, when changing the position of the first hinge 51 as shown in FIG. 8, it may suffice that the producer or operator moves the first switch 61 so that the input 45 contacts the second contact 617 and then moves the first hinge from the first fastener 311*a* to the second fastener 311*b*.

Further, the shaft cover stopper 311*c* and the body fastener 311*d* are axially-symmetrical with respect to each other around the vertical line H1. Thus, when changing the positions of the second hinge 53 and the third hinge 55, it may suffice that the operator secures the second hinge 53 to the door via the body stopper 311*d*, and secures the third hinge 55 to the door via the cover stopper 311*c*.

In this case, the operator must position the second switch 63 so that the first inclined face 632*b* disposed on the first movable portion contacts the first free end 61*e* of the first switch.

In one example, in the laundry-treating apparatus 100 having only the structure described above, when the door 3 pivots around the first pivoting axis X and when the user presses the first handle body 41 and inputs an external force to the handle, the first shaft 511*b* may be separated from the first shaft receiving structure 513.

Further, in the laundry-treating apparatus 100 having the above-described structure, when the door 3 pivots around the second pivoting axis Y, the first body 41 must be kept at a pressed state to prevent the free end 631*e* of the second switch from being drawn out from the through-hole 557*b*, that is, to prevent the fourth shaft from being drawn out from the fourth shaft receiving space.

In order to solve the above-mentioned disadvantages, the laundry-treating apparatus 100 according to the present disclosure may further include locking means 7 and 8. When the door 3 opens the laundry inlet 111, that is, when the door body is detached from the front panel, the locking means 7 and 8 fix the position of the first switch 61 and second switch 63.

FIG. 7 shows an example in which the locking means includes both a first lock 7 that locks the position of the first switch 61 and a second lock 8 that locks the position of the second switch 63.

Figure 9:
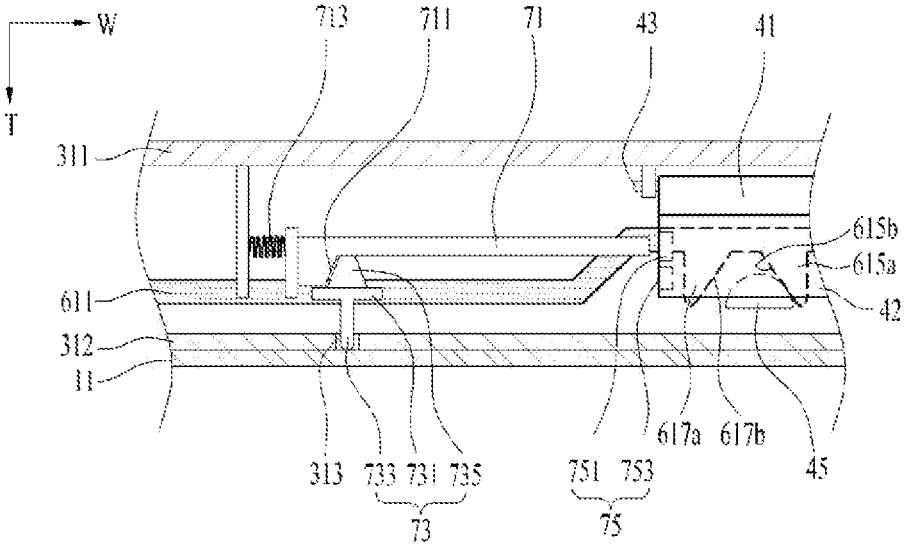
FIG. 9 and FIG. 10 illustrate one example of first and second locks in accordance with the present disclosure.

As shown in FIG. 9, the first lock 7 may include a first lock body 71 detachably mounted on the handle 4, a first lock support 713 that exerts an elastic force to move the first lock body 71 toward the handle 4, and a first movable lock portion 73 for separating the first lock body 71 from the handle 4.

The first lock body 71 may include a bar shaped bar. The first lock body 71 may be pressed by a first lock support 713 toward the second handle body 42. The first lock support 713 may include a spring for urging a free end of the first lock body 71 toward the second handle body 42.

The first lock body 71 has a first inclined lock face 711 which is urged by the first movable lock portion 73. The first inclined lock face 711 may have an upwards slope as it goes away from the handle 4.

When the door 3 closes the laundry inlet 111, the first movable lock portion 73 moves the first lock body 71 in a direction away from the second handle body 42. When the door 3 opens the laundry inlet 111, the first movable lock portion 73 moves the first lock body 71 toward the second handle body 42.

To this end, the first movable lock portion 73 may include a movable body 731 which reciprocates along the thickness direction T of the door 3, and pressing means 733 and 735 for separating the first lock body 71 from the second handle body 42 upon contacting the front panel 11.

The pressing means may include first pressing means 733 fixed to the movable body 731 and passing through the inner frame 312, and second pressing means 735 fixed to the movable body 731 and contacting the first inclined lock face 711. In this case, the inner frame 312 may further include a first through-hole 313 into which the first pressing means 733 is inserted.

The first movable lock portion or pin 73 may be fixed to the front panel 11, unlike the manner as shown in the drawing. In this case, when the door 3 closes the laundry inlet 11, the first movable lock portion 73 may be configured to be inserted into the first through-hole 313 to press the first inclined lock face 711.

In one example, the first lock body 71 may be coupled to the second handle body 42 via a first lock catch 75. In this case, the first lock catch 75 may include a first stopper 751 and a second stopper 753 disposed on the second handle body 42 and receiving the free end of the first lock body 71.

When the user pivots the door 3 without pressing the first handle body 41, that is, when the door pivots around the first pivoting axis, the first lock body 71 is coupled to the first stopper 751. When the user presses the first handle body 41 and pivots the door 3, that is, when the door pivots about the second pivoting axis, the first lock body 71 is coupled to the second stopper 753.

Figure 10:
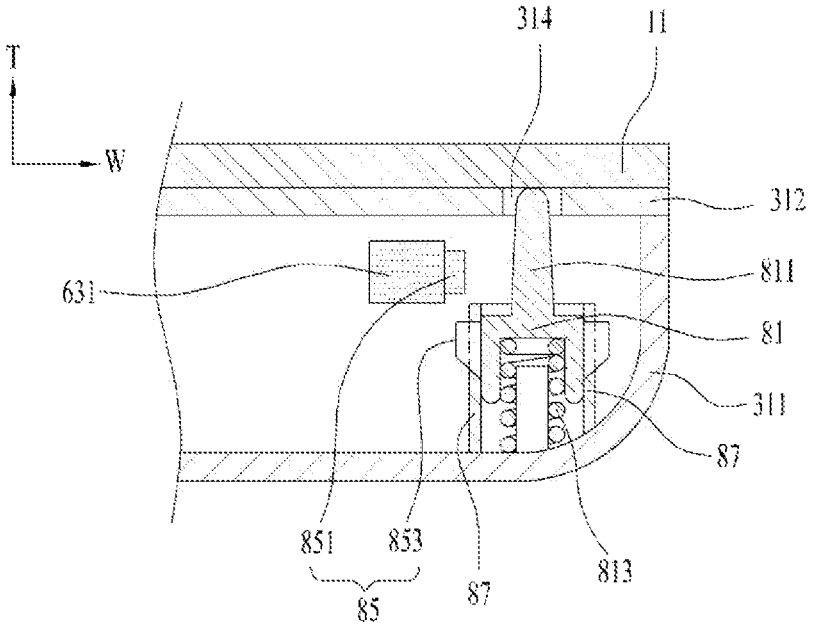
Figure 10:
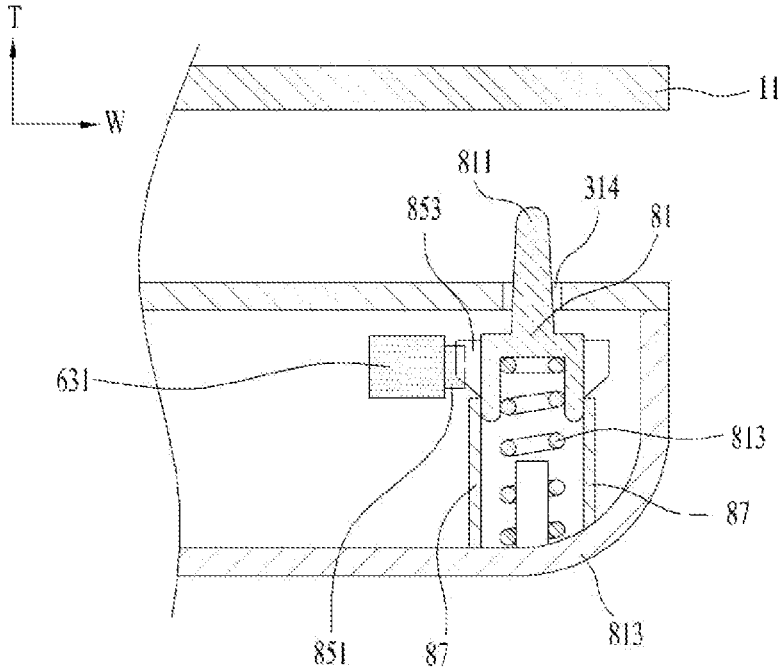

As shown in FIG. 10, the second lock 8 may include a second lock body 81 which reciprocates within the door 3 along the thickness direction T of the door 3, a second lock support 813 that provides a restoring force to the second lock body 81, a second movable lock portion 811 that moves the second lock body 81 in a direction away from the front panel 11 when the door 3 closes the laundry inlet, and a second lock catch 85. When the door 3 closes the laundry inlet 11, the second lock catch 85 separates the second lock body 81 from the first body 631 of the second switch 63. When the door 3 opens the laundry inlet 11, the second lock catch 85 connects the second lock body 81 to the first lock body 631 of the second switch 63.

The second lock body 81 is guided along a second lock guide 87 disposed on the door 3 and moves inside the door 3. The second lock support 813 may include a spring that connects the second lock body 81 and the door body 31. In this case, the second lock support 813 is preferably configured to press the second lock body 81 toward the inner frame 312, that is, toward the laundry inlet.

The second movable lock portion 811 may pass through the inner frame 312 and be fixed to the second lock body 81. In this case, the inner frame 312 should have a second through-hole 314 defined therein through which the second movable lock portion 811 passes.

In an alternative, the second movable lock portion 811 may be fixed to the front panel 11. In this case, the second movable lock portion 811 should be configured to be inserted into the second through-hole 314 to press the second lock body 81 when the door 3 closes the laundry inlet 111.

The second lock catch 85 may include a first stopper 851 disposed on the first body 631 of the second switch 63, and a second stopper 853 disposed on the second lock body 81 and removably mounted on the first stopper 851.

The second lock catch 85 may be configured in any form as long as it can implement the above function. FIG. 10 shows one example that the first stopper 851 protrudes from an outer peripheral surface of the first body 631 of the second switch 63 and a second stopper 853 protrudes from an outer circumferential surface of the second lock body 81.

Figure 11:
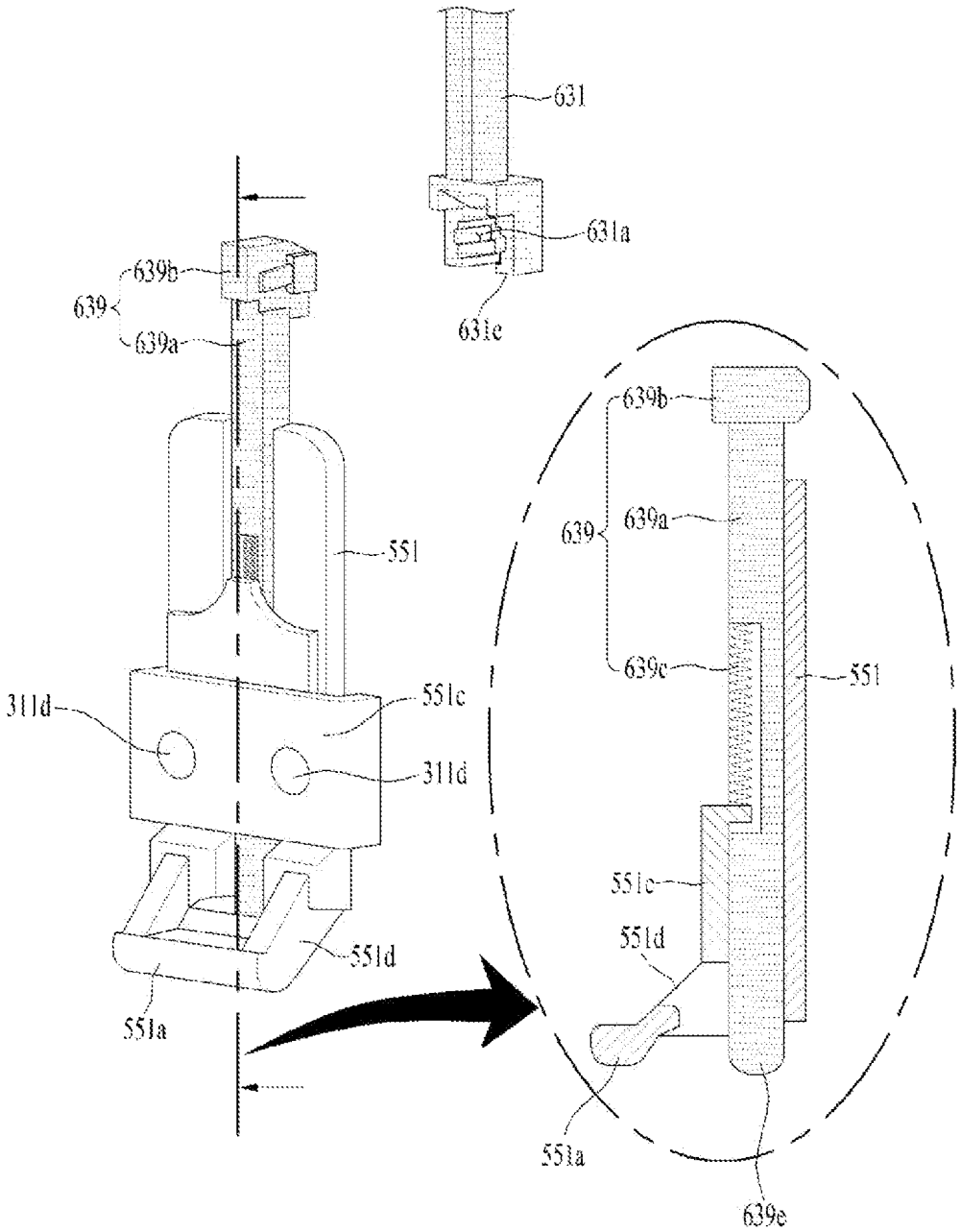
FIG. 11 and FIG. 12 shows another embodiment of a second switch in accordance with the present disclosure.

FIG. 11 shows another embodiment of a second switch 63 in accordance with the present disclosure. This embodiment is characterized in that the second switch 63 as described above a fourth shaft controller 639. The fourth shaft controller 639 may be detachably attached to the first body 631 to further open and close the fourth shaft receiving space 552*b*.

The fourth shaft controller 639 may include a second bar 639*a* which is reciprocally movable along the vertical direction of the third hinge body 551. In this case, the third hinge body 551 may further have a guide 551*c* for providing a travel path of the second bar 639*a*. The guide 551*c* may have at least one of a groove extending along the vertical direction of the third hinge body 551 and providing a space for receiving the second bar 639*a* therein, and a cover to prevent the second bar 639*a* inserted in the groove from being drawn out of the groove.

One end of the second bar 639*a* includes a second head 639*b* that is detachably coupled to the first body 631. The second head 639*b* is detachably coupled into the first attached and detached portion 631*a* disposed in the first body of the second switch.

A free end 639*e* of the second bar is located in a space defined in the fourth shaft support 551*d* and between the fourth shaft 551*a* and the third hinge body 551.

When the handle 4 and the first switch 61 allow the first body 631 of the second switch 63 to move toward the fourth shaft 551*a*, the free end 639*e* of the second bar will be inserted into the through-hole 557*b* defined in the switch receiving portion 557, thus closing the fourth shaft receiving space 552*b*. However, when the first body 631 of the second switch moves away from the fourth shaft 551*a*, the free end

639*e* of the second bar will be withdrawn from the through-hole 557*b* so that the fourth shaft receiving space 552*b* will be opened.

The second bar 639*a* may be configured to receive a restoring force from a second elastic member 639*c* such that the bar 639*a* returns to its initial position. The second elastic member 639*c* may be embodied as a spring having one end fixed to the third hinge body 551, and the other end fixed to the second bar 639*a*.

The second elastic member 639*c* is preferably configured to supply an elastic force to the second bar 639*a* so that the free end 639*e* of the second bar remains at a state to open the fourth shaft receiving space 552*b*. In this case, the restoring means 633 disposed on the second switch 63 may be omitted.

Figure 12:
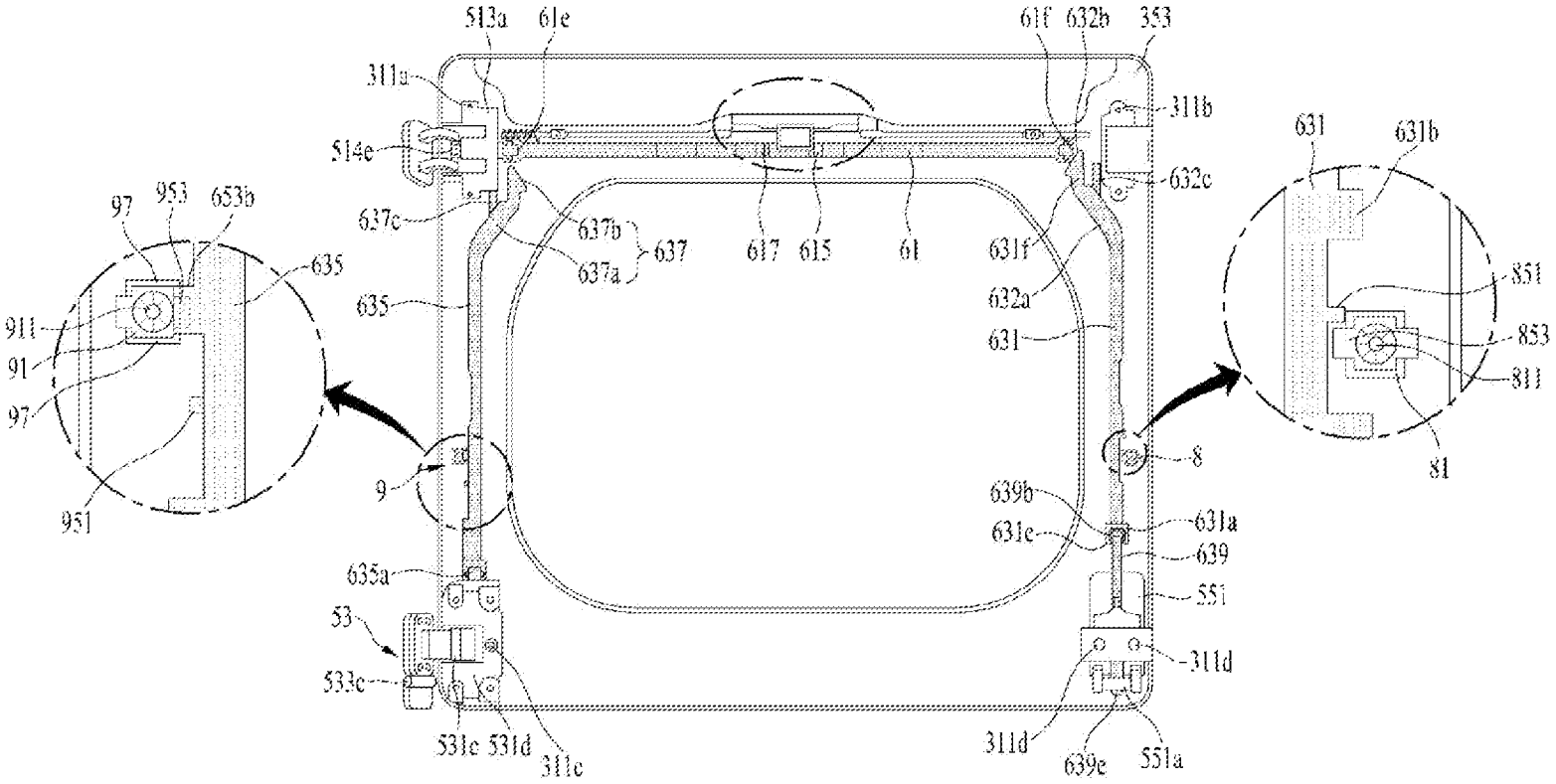

FIG. 12 shows another embodiment of a second switch 63 in accordance with the present disclosure. The second switch 63 according to this embodiment includes a first body 631 located between the second fastener 311*b* and the fourth shaft 551*a*, a second body 635 between the first fastener 311*a* and the second hinge 53, and a fourth shaft controller 639 fixed to either the first body 631 or the second body 635 according to the position of the first pivoting axis X.

The first body 631 contacts the second free end 61*f* of the first switch via the first movable portion 632. The fourth shaft controller 639 is coupled through the first attached and detached portion 631*a* to the first body 631. A structure of the first body 631, a structure of the first movable portion 632 and a structure of the fourth shaft controller 639 are as described above. Thus, detailed descriptions thereof will be omitted.

The second switch 635 has the same shape as the first body 631. That is, one end of the second body 635 of the second switch has a second movable portion 637, while the other end thereof includes a second attached and detached portion 635*a* to which the fourth shaft controller 639 is detachably secured.

The second movable portion 637 acts for connecting the second body 635 to the first free end 61*e* of the first switch. This second movable portion 637 may include a second connection body 637*a* extending from the second body 635 towards the first switch 61, and a second inclined face 637*b* disposed on the second connection body and contacting the first free end 61*e* of the first switch. The second inclined face 637*b* may have a downward slope as it goes away from the second attached and detached portion 635*a*.

When the housing 513*a* of the first hinge is fixed by the first fastener 311*a* (state of FIG. 12), the first body 631 is configured to contact the second free end 61*f* of the first switch via the first movable portion 632. In this case, when the first switch 61 moves the first shaft controller 514 to open the first shaft receiving space 513*b*, the first body 631 will move toward the fourth shaft 551*a*.

When the housing 513*a* is secured by the first fastener 311*a*, the second body 635 is detachably secured to and between the first fastener 311*a* and the second hinge 53, while the fourth shaft controller 639 passes through the first attached and detached portion 631*a* and is fixed to the first body 631.

In this case, when the handle 4 and the first switch 61 cause the first body 631 to move toward the fourth shaft 551*a*, the free end 639*e* of the fourth shaft controller will be inserted into the through-hole 557*b* to close the fourth shaft receiving space 552*b*.

In this embodiment, the position change of the first pivoting axis X defined by the first shaft 551*b* of the first hinge and the second shaft 531*c* of the second hinge is performed as follows. The housing 513*a* is secured by the second fastener 311*b*; the second hinge 53 is secured to the door via the body fastener 311*d*; and the third hinge body 551 is fixed to the door via the cover fastener 311*c*.

When the housing 513*a* is secured by the second fastener 311*b*, the first body 631 will be removably secured to and between the second fastener 311*b* and the second hinge 53.

On the other hand, when the housing 513*a* is secured by the second fastener 311*b*, the second body 635 of the second switch is displaced to contact the first free end 61*e* of the first switch. The fourth shaft controller 639 is fixed to the second attached and detached portion 635*a* defined in the second body.

Thus, when the handle 4 and the first switch 61 cause the second switch 635 to be moved toward the fourth shaft 551*a*, the free end 639*e* of the fourth shaft controller will be inserted into the through-hole 557*b* to close the fourth shaft receiving space 552*b*.

In order that the second body 635 is detachably secured to and between the housing 513*a* and the second hinge 53 when the housing 513*a* is secured by the first fastener 311*a*, the second body 635 may further include a second protrusion 637*c* protruding from the second movable portion 637 toward the first fastener 311*a*.

When the housing 513*a* is fixed to the second fastener 311*b* for repositioning of the first pivoting axis X, and when the position of the second hinge 53 and the position of the third hinge body 551 are exchanged with each other, the first body 631 may be detachably secured to and between the housing 513*a* and the second hinge 53. To this end, the first body 631 may further include a first protrusion 632*c* protruding from the first movable portion 632 toward the second fastener 311*b*.

The laundry-treating apparatus according to the present embodiment may further include a second lock 8 for fixing the position of the first body 631 and a third lock 9 for fixing the position of the second body 635 when the door opens the laundry inlet.

The second lock 8 may be configured to fix the position of the first body 631 when the door 3 opens the laundry inlet 111 while the housing 513*a* is secured by the first fastener 311*a*. A concrete structure and actuation process thereof are as described with reference to FIG. 10. Thus, detailed descriptions thereof are omitted.

The third lock 9 refers to means for securing the position of the second body 635 when door 3 opens the laundry inlet 111 while the housing 513*a* is secured by the second fastener 311*b*. The third lock 9 may have the same structure as the second lock 8.

That is, the third lock 9 includes a third lock body 91 reciprocating within the door 3 along the thickness direction T of the door 3, a third lock support 913 which supplies a restoring force to the third lock body 91, a third movable lock portion 911 that moves the third lock body 91 in a direction away from the front panel 11 when the door 3 closes the laundry inlet, and a third lock catch 95. The third lock catch 95 separates the third lock body 91 from the second body 635 when the door 3 closes the laundry inlet 11. The third lock catch 95 couples the third lock body 91 into the second body 635 when the door 3 opens the laundry inlet 111.

The third lock body 91 may be configured to move within the door 3 under the guidance by the third lock guide 97 disposed on the door 3. The third movable lock portion 911 may pass through the inner frame 312 and be fixed to the third lock body 91. In this case, the inner frame 312 should have a third through-hole 315 (see FIG. 3) defined therein through which the third movable lock portion 911 passes.

The third lock catch 95 may include a first stopper 951 disposed on the second body 635, and a second stopper 953 disposed on the third lock body 91 and detachably coupled to the first stopper 951.

In the laundry-treating apparatus having the above-described second lock 8 and third lock 9, when the second movable lock portion 811 and the third movable lock portion 911 are always exposed to the outside of the door, there may be a problem that either the second movable lock portion 811 and the third movable lock portion 911 interfere with the pivot of the door when pivoting the door 3 for closing the laundry inlet 111.

For example, when the housing 513*a* is secured by the first fastener 311*a*, the second body 635 plays no role in configuring the pivoting axis (X, Y). In this case, when the third movable lock portion 911 remains exposed to the outside of the door through the third through-hole 315, the third movable lock portion 911 will contact the front panel 11 when pivoting the door 3 toward the front panel 11. This may interfere with the pivoting of the door 2.

For solving the above-mentioned problem, the laundry-treating apparatus according to the present embodiment may further include pressing means or a latch 631*b* for the second lock and pressing means or a latch 635*b* for the third lock.

The pressing means 635*b* for the third lock may act to press the second stopper 953 in the direction away from the second body 635 such that the third movable lock portion 911 is not exposed to the outside of the door 3 when the housing 513*a* is fixed by the first fastener 311*a* and the second body 635 is positioned between the housing 513*a* and the second hinge 53.

In one example, the pressing means 631*b* for the second lock may be means for urging the second stopper 853 in a direction away from the first body 631 so that the second movable lock portion 811 is not exposed to the outside of the door 3 when the housing 513*a* is fixed by the second fastener 311*b* and the first body 631 is positioned between the housing 513*a* and the second hinge 53.

The present disclosure may be embodied in various forms without departing from the scope of the invention. Therefore, when modified embodiments include elements recited claims according to the present disclosure, the modified embodiments should be regarded as belonging to the scope of the present disclosure.

What is claimed is:

1. A laundry-treating apparatus comprising:

a cabinet having an inlet formed therein;

a door configured to open and close the inlet;

first and second fasteners provided on the door, wherein the first and second fasteners are axially symmetrical to each other about a vertical centerline of the door;

a first hinge including:

a first shaft attached to the cabinet;

a housing fixed to the door by the first fastener or the second fastener; and a first shaft receiving space defined in the housing, wherein the first shaft is configured to be received in the first shaft receiving space;

a second hinge including:

a second shaft coupled to the door, wherein the first and second shafts are coaxial and collectively define a first pivoting axis; and a third shaft arranged perpendicular to the second shaft wherein the third shaft defines a second pivoting axis about which the door pivots in a second direction different from the first direction;

a third hinge including:

a fourth shaft attached to the door, wherein the third and fourth shafts are coaxial and collectively define the second pivoting axis;

a fourth shaft receiving space provided at the cabinet, wherein the fourth shaft receiving space is configured to receive the fourth shaft therein; and a receiving body provided at the cabinet and arranged below the fourth shaft receiving space;

a handle including:

a handle body pivotably secured to the door; and an input fixed to the handle body;

a first linkage provided between the first fastener and the second fastener, wherein the first linkage includes first and second contact points, wherein when the handle body pivots when the housing is fixed by the first fastener, the input actuates the first contact point to allow the first linkage to move in a direction from the first fastener toward the second fastener, and wherein when the handle body pivots when the housing is fixed by the second fastener, the input actuates the second contact point to allow the first linkage to move in a direction from the second fastener toward the first fastener, a first shaft latch configured to secure the first shaft within the first shaft receiving space, wherein when the housing is fixed by the first fastener, the first shaft latch is fixed to a first free end of the first linkage that faces the first fastener, wherein when the housing is fixed by the second fastener, the first shaft latch is fixed to a second free end of the first linkage that faces the second fastener, and wherein the first shaft latch is configured to open or close the first shaft receiving space when the first linkage moves; and a second linkage, wherein when the first linkage moves the first shaft latch to open the first shaft receiving space, one of the first and second free ends of the first linkage opposite of the first shaft latch moves the second linkage toward the fourth shaft to insert the second linkage into a through hole provided in the receiving body to latch the fourth shaft into the fourth shaft receiving space.

2. The laundry-treating apparatus of claim 1, further comprising:

a first accommodation groove defined in the first free end of the first linkage, wherein the first shaft latch is configured to be received in the first accommodation groove;

a second accommodation groove defined in the second free end of the first linkage, wherein the first shaft latch is configured to be received in the second accommodation groove;

a cover configured to cover the second shaft within the door;

a cover fastener configured to secure the cover to the door; and a body fastener configured to secure the fourth shaft to the door, wherein the cover and body fasteners are positioned axially symmetrical with each other about the vertical centerline of the door.

3. The laundry-treating apparatus of claim 2, wherein the first hinge further includes:

a guide provided at the housing to guide a movement of the first shaft latch; and a first spring having a first end fixed to the housing and a second end fixed to the first shaft latch, wherein the spring is configured to press the first shaft latch to close the first shaft receiving space.

4. The laundry-treating apparatus of claim 3, further comprising an elastic member configured to provide an elastic force to the second linkage to open the fourth shaft receiving space.

5. The laundry-treating apparatus of claim 4, wherein the elastic member includes:

a casing detachably secured to the door, wherein the second linkage passes through the casing; and a second spring having a first end fixed to the casing and a second end fixed to the second linkage, wherein the second spring is configured to provide an elastic force to the second linkage to open the fourth shaft receiving space.

6. The laundry-treating apparatus of claim 5, further comprising:

first and second through-holes respectively provided in the casing, wherein the second linkage passes through the first and second through-holes;

a third through-hole defined in the bottom of the casing;

a stopper that extends from the second linkage, wherein the stopper is positioned between the first through-hole and the third through-hole; and a guide that extends from the stopper and is inserted into the third through-hole, wherein the guide is configured to guide a movement of the second linkage.

7. The laundry-treating apparatus of claim 1, wherein the second linkage includes:

a second linkage body, wherein when the housing is fixed by the first fastener, the second linkage body contacts the second free end of the first linkage, wherein when the housing is fixed by the second fastener, the second linkage body contact the first free end of the first linkage, wherein when the first linkage moves the first shaft latch to release the first shaft from the first shaft receiving space, the second linkage body moves toward the fourth shaft, and a fourth shaft latch, wherein the fourth shaft latch is detachably secured to the second linkage body, wherein when the second linkage body moves toward the fourth shaft, the fourth shaft latch is inserted into the through hole provided in the receiving body.

8. The laundry-treating apparatus of claim 7, wherein the third hinge includes:

a third hinge body fixed to the door;

a shaft support configured to secure the fourth shaft to the third hinge body, wherein the shaft support separates the fourth shaft and the third hinge body from each other;

a guide provided at the third hinge body to guide the fourth shaft latch into the through hole provided in the receiving body; and a spring having a first end secured to the third hinge body and a second end secured to the fourth shaft latch, wherein the spring is configured to remove the fourth shaft latch from the through hole.

9. The laundry-treating apparatus of claim 1, further comprising a first lock, wherein when the door opens the inlet, the first lock is configured to lock the first linkage in a predetermined position.

10. The laundry-treating apparatus of claim 1, wherein the second linkage includes:

a first body, wherein when the housing is fixed by the first fastener, the first body contacts the second free end of the first linkage, wherein when the first linkage moves the first shaft latch to release the first shaft from the first shaft receiving space, the first body moves toward the fourth shaft;

a second body, wherein when the housing is secured by the first fastener, the second body is detachably secured into and between the housing and the second hinge, wherein the first and second bodies have the same shape; and a fourth shaft latch configured to latch the fourth shaft into the fourth shaft receiving space, wherein when the housing is secured by the first fastener, the fourth shaft latch is secured to the first body, wherein when the housing is fixed by the second fastener, the fourth shaft latch is secured to the second body, wherein when the first body or second body moves toward the fourth shaft, the fourth shaft latch is inserted into the through hole provided in the receiving body to lock the fourth shaft into the fourth shaft receiving space.

11. The laundry-treating apparatus of claim 10, wherein when the housing is secured by the second fastener, and when a position of the second hinge and a position of the third hinge change to define the first pivoting axis and the second pivoting axis, the first body is detachably secured into and between the housing and the second hinge, wherein when the first linkage moves the first shaft latch to release the first shaft from the first shaft receiving space, the first free end of the first linkage contacts the second body to move toward the fourth shaft, and the fourth shaft latch is secured to the second body.

12. The laundry-treating apparatus of claim 11, further comprising:

a first protrusion that protrudes from the first body toward the second fastener, wherein when the housing is secured by the second fastener, the first protrusion allows the first body to be positioned between the housing and the second hinge; and a second protrusion that protrudes from the second body toward the first fastener, wherein when the housing is secured by the first fastener, the second protrusion allows the second body to be positioned between the housing and the second hinge.

13. The laundry-treating apparatus of claim 12, further comprising:

a second lock, wherein when the door opens the inlet while the door is secured by the first fastener, the second lock is configured to lock the first body; and a third lock, wherein when the door opens the inlet while the door is secured by the second fastener, the third lock is configured to lock the second body.

14. The laundry-treating apparatus of claim 13, wherein the second lock includes:

a second lock body provided in the door;

a second lock support configured to provide an elastic force to press the second lock body toward the first body of the second linkage;

a second pin configured to pass through the door and fixed to the second lock body, wherein when the door closes the inlet, the second lock body is moved away from the first body of the second linkage;

a first stopper provided on the first body of the second linkage; and a second stopper provided on the second lock body, wherein when the door opens the inlet, the second stopper is engaged with the first stopper to prevent movement of the first body of the second linkage, wherein when the door closes the inlet, the second stopper separates from the first stopper, wherein the third lock includes:

a third lock body provided in the door;

a third lock support configured to provide an elastic force to press the third lock body toward the second body of the second linkage;

a third pin configured to pass through the door and fixed to the third lock body, wherein when the door closes the inlet, the third lock body is moved away from the second body of the second linkage;

a first stopper provided on the second body of the second linkage; and a second stopper provided on the third lock body, wherein when the door opens the inlet, the second stopper of the third lock is engaged with the first stopper of the third lock to prevent movement of the second body of the second linkage, wherein when the door closes the inlet, the second stopper of the third lock is separated from the first stopper of the third lock.

15. The laundry-treating apparatus of claim 14, further comprising:

a second lock latch, wherein when the housing is secured by the second fastener and the first body of the second linkage is positioned between the housing and the second hinge, the second lock latch is configured to press the second stopper of the second lock away from the first body of the second linkage so that the second pin is not exposed to an outside of the door; and a third lock latch, wherein when the housing is secured by the first fastener and the second body of the second linkage is positioned between the housing and the second hinge, the third lock latch is configured to press the second stopper of the third lock away from the second body of the second linkage so that the third pin is not exposed to an outside of the door.

16. A home appliance comprising:

a cabinet having an inlet formed therein;

a door configured to open and close the inlet;

first and second fasteners provided on the door, wherein the first and second fasteners are axially symmetrical to each other about a vertical centerline of the door;

a first hinge including:

a first shaft attached to the cabinet;

a housing fixed to the door by the first fastener or the second fastener; and a first shaft receiving space defined in the housing and configured to receive the first shaft therein;

a second hinge including:

a second shaft coupled to the door, wherein the first and second shafts are coaxial and collectively define a first pivoting axis; and a third shaft arranged perpendicular to the second shaft wherein the third shaft defines a second pivoting axis about which the door pivots in a second direction different from the first direction;

a third hinge including:

a fourth shaft attached to the door, wherein the third and fourth shafts are coaxial and collectively define the second pivoting axis; and a fourth shaft receiving space provided at the cabinet and configured to receive the fourth shaft therein;

a first linkage provided between the first fastener and the second fastener and configured to move in a lateral direction between the first fastener and the second fastener, and a second linkage, configured to move toward the fourth shaft to lock the fourth shaft into the fourth shaft receiving space.

17. The home appliance of claim 16, further comprising:

a first shaft latch connected to a first end of the first linkage and configured to lock the first shaft into the first shaft receiving space; and a fourth shaft latch connected to a first end of the second linkage and configured to lock the fourth shaft into the fourth shaft receiving space.

18. The home appliance of claim 17, further comprising a first lock attached to the door, wherein when the door opens the inlet, the first lock is configured to lock the first linkage in a predetermined position.

19. The home appliance of claim 18, further comprising a second lock attached to the door, wherein when the door opens the inlet, the second lock is configured to lock the second linkage in a predetermined position.

20. The home appliance of claim 16, further comprising a handle pivotably attached to the door and including a protrusion in contact with the first linkage, wherein when the handle is pressed, the protrusion moves the first linkage in the lateral direction between the first fastener and the second fastener.

* * * * *